United States Patent [19]

Airhart

[11] 4,234,190

[45] Nov. 18, 1980

[54] CARBON FIBER-REINFORCED PLASTIC ARROW

[75] Inventor: Tom P. Airhart, Hurst, Tex.

[73] Assignee: Skyline Industries, Inc., Fort Worth, Tex.

[21] Appl. No.: 875,547

[22] Filed: Feb. 6, 1978

[51] Int. Cl.[3] ..... F41B 5/02

[52] U.S. Cl. ..... 273/420; 273/DIG. 7; 273/DIG. 23; 428/377

[58] Field of Search ..... 273/106.5 R, DIG. 7, 273/DIG. 23; 428/367, 376, 377, 398

[56] References Cited

U.S. PATENT DOCUMENTS

| | | | |
|---|---|---|---|
| 2,747,876 | 5/1956 | Teller | 273/106.5 R |
| 4,097,626 | 6/1978 | Tennent | 428/377 X |

OTHER PUBLICATIONS

Science Looks at Archery, Monograph Bulletin No. 1, Archery Review, 7-1935 by Paul E. Klopsteg.

Archer's Bible, 3-1967, p. 53.

Archery Magazine, p.7, "Graphflite Arrows", 12-1975.

*Primary Examiner*—Paul E. Shapiro

*Attorney, Agent, or Firm*—Dressler, Goldsmith, Shore, Sutker & Milnamow, Ltd.

[57] ABSTRACT

A carbon fiber-reinforced plastic arrow is disclosed having a tubular shaft with a length of from 25 to 32 inches, a wall thickness of from 0.022 to 0.032 inch and an internal diameter of from 0.19 to 0.26 inch, the shaft having a stiffness measured by center deflection under a two pound center load of from 0.25 to 0.7 inch. The tubular shaft is constructed of carbon fiber-reinforced plastic to include an interior section in which the carbon fibers run in two directions, each balanced with respect to the other, of at least 30° to the axis of the arrow, and an outer section in which substantially all of the fibers are parallel to the axis of the arrow, and the arrow includes a head having a weight of from 45% to 60% of the weight of the shaft.

4 Claims, 6 Drawing Figures

CARBON FIBER-REINFORCED PLASTIC ARROW

The present invention relates to arrows made of carbon fiber-reinforced plastic.

Arrows have been made of wood throughout history, but the weight and nonuniformity of wood prevents them from meeting the high performance requirements of modern archery which is, today, almost exclusively served by arrows having an aluminum shaft. Arrows with a fiberglass shaft were popular for a time, but the superior performance of the aluminum arrows has caused these to displace the fiberglass arrows. However, while the aluminum arrows are the best now available, this invention provides an arrow which is distinctly superior to the aluminum arrow, as will be explained. Also, carbon fibers have previously been used in arrows, but these compare poorly with the aluminum arrows, particularly in the area of arrow damage, where the aluminum shafts, while poor, are better than the fiber-containing arrows, though not as good as those provided by this invention.

More particularly, drawn precision aluminum tubes are generally accepted as possessing the most superior characteristics of conventional arrow shafts currently available commercially, having supplanted solid cedar wood and hollow woven fiberglass reinforced plastic shafts previously favored. An alternate construction considered less optimum is plastic reinforced by aligned yarns of glass.

More recently, plastics partially reinforced in selected directions by graphite fiber yarns have been introduced as an extension of the practice used in the design and fabrication of various products which incorporate unwoven glass yarn, these being illustrated by reinforced arrows and fishing rod designs utilizing conventional axially aligned graphite fibers and transversely wrapped glass fabric. Performance has been improved by the application of graphite fibers, but currently available graphite/glass arrows have less durability and poor straightness and balance relative to aluminum shafts. More particularly, the combination of axial graphite fibers and transverse glass fabric results in greatly reduced torque strength, and this combination is not effective against energy losses due to circumferential deformation. This deformation can take the form of a change in the cross-section of the shaft or it can result in axial twisting along the length of the shaft. Also, axial orientation of graphite fibers in a thin shell tube, either alone or in combination with glass fiber reinforcement, would be expected to result in the production of a high proportion of curved shafts which would not exhibit uniform stiffness if rotated from one position to another for flexural measurement.

The problem of providing a superior arrow has not been a simple one.

Referring first to the stresses imposed upon an archery arrow, the arrow is subjected to several different situations in sequence. The arrow initially rests in a stationary position supporting its own weight between a forward support point or rest on the bow, and a rearward support point at the nock when the arrow is held against the bow string, sliding over the rest. The force of the released string against the inertia of the arrow tends to bend the shaft as it leaves the bow. The released arrow then bends back due to its own elastic rigidity and continues to sustain a damped vibration about its axis as it travels through the air. In this travel, the arrow is stabilized by the internal damping of the shaft and the fletching contacting air resistance which aids in axial alignment. The fletching is often angled to impart an axial spin to the arrow for added stability. Finally, the target is struck by the point of the arrow, and the arrow shaft transmits the kinetic energy stored in the rearward elements of the moving arrow forward to the head or point of the arrow. This energy is then transformed into mechanical work which causes penetration into the target. Recent advances in archery bow design, with associated higher energy levels, have placed more stringent requirements on arrow performance.

Bows of different stiffness requiring different drawing force to be exerted by the bowman will, in turn, propel an arrow with different forces. For satisfactory accuracy, arrow stiffness should be matched to the drawing force of a particular bow to minimize initial deflections of the arrow shaft. This arrow stiffness is defined as the center deflection of an arrow shaft under a two-pound center load while simply supported at both ends. Generally, satisfactory emperical relationships have previously been made between stiffness measurements and bow draw weights, and such relationships are also utilized in this invention, due regard being had for the inertia of the mass of the shaft which is different in a carbon fiber arrow.

A lighter weight arrow, of sufficient rigidity, can be cast at a higher velocity by a bow of given draw weight. Higher velocity of the arrow maximizes the kinetic energy of the arrow by the square of the velocity. In addition to maximizing kinetic energy, it is also advantageous to maintain momentum which is a function of mass, so in this invention, I combine a lighter, but still adequately rigid shaft, with a heavier tip whereby to achieve greater target penetration and added stability in flight, the latter being especially important under windy conditions in field target shooting. In all cases of weight distribution, the light, stiff shaft achieved in this invention more effectively conducts the energy or inertia of the arrow forward to the tip to penetrate the target. Energy losses are also observed for conventional arrows in the process of transforming energy stored in the flexed bow into kinetic energy in the moving arrow. The heavier and more flexible aluminum shaft initially deforms and loses more energy in transverse vibrations immediately upon leaving the bow, and this is directly measurable in the initial wobble observed in the flight of an arrow. This initial wobble is reduced in this invention.

Several common situations encountered in archery may impose unexpectedly high loads on the arrow. Bowhunting may result in arrows point impacting on hard, rigid objects such as trees, rocks, and soil, or striking glancing impacts on tough grass turf and smaller limbs of trees. In target shooting, arrows may also miss the target and strike backstops of various types, or arrows in the target face may be struck by subsequent incoming arrows. Twisting about the shaft axis may occur as an arrow is withdrawn from the target. These diverse impacts and loadings are better resisted by the arrows of this invention.

With all of the foregoing in mind, in this invention the arrow shaft is tubular with a length of from 25 to 32 inches, the tube having a wall thickness of from 0.022 to 0.032 inch with an internal diameter of from 0.19 to 0.26 inch. The larger internal diameters and greater wall thicknesses are used with the longer arrow lengths so as to provide a stiffness (measured by the 2 pound center loading test) of from 0.25–0.7 inch, preferably from 0.35–0.65 inch. These arrows are constructed of carbon fiber-reinforced plastic to include an interior section in which the carbon fibers run in two directions, each balanced with respect to the other, of at least 30° to the axis of the arrow, preferably about 45°, and an outer section in which substantially all of the fibers are parallel to the axis of the arrow, this outer section being preferably constituted by from 1–4, preferably 2 or 3, outer layers of parallel carbon fiber rovings. The arrow shaft is then provided with a heavy head (including any insert therein), this heavy head preferably constituting from 45% to 60% of the weight of the shaft. In contrast, a typical aluminum arrow would have a head weighing about 33–39% of the weight of the shaft.

The result is an arrow which can be propelled at a flatter trajectory and which possess superior penetration capacity. Also, it better resists twisting and impact, and thus is more resistant to damage. Expert archers using groups of six arrows at 20 yards will produce small shot groups and cause incoming arrows to strike those already on the target. An average of two aluminum arrows will be damaged for every four rounds of six arrows. Substituting the graphite/glass shafted arrows currently available, about four such arrows will be damaged instead of two. In the same test, repeated several times, with the arrows of this invention, no arrows were damaged. More particularly, in the standard test, six arrows are shot four times apiece, a total of 24 shots. No damage resulted in this invention when the six arrows were shot repeatedly for 100 rounds, and some of these were at a distance of only 5 yards from target to maximize damage.

The invention will be more fully described in connection with the accompanying drawing in which:

FIGS. 1 and 2 show the winding of a mandrel to provide an interior section in which the carbon fibers run in two directions;

FIG. 3 shows the wrapping of the interior section;

FIG. 4 shows the final wrapped mandrel from which, after confinement within a nonadhesive sheath and curing, the cured arrow shaft is ultimately removed;

Referring more particularly to the drawings, the numeral 10 identifies a cylindrical mandrel which has been appropriately treated to provide a release surface and it is shown with a long strip 11 having parallel sides wound around it, the strip 11 being constituted by a layer of plastic having parallel rovings of carbon (graphite) fiber held together by an appropriate plastic.

The plastic is conveniently a heat softenable plastic and may be thermoplastic or thermosetting, the latter being preferred. The plastics which may be used are well known and any hard plastic may be used. Unlike glass fiber, there is no difficulty in obtaining good adhesion to carbon fiber. The conventional epoxy resin systems as described in my U.S. Pat. No. 4,043,074 dated Aug. 23, 1977, are preferably used herein, and these cure on heating. The proportion of plastic may vary widely, so long as enough is used to bind the fibers together. Preferably about 50–60% of the layer is carbon fiber, the balance plastic. The more carbon fiber, the stiffer the shaft, but it will be recalled that the shaft stiffness must be within the bounds previously described.

Unidirectional carbon or graphite fiber-reinforced plastic, as used in this invention, is composed in its elemental form of rigid, high strength fibers of parallel alignment constrained to act as a coherent mass by a tough interfiber matrix of thermosetting or thermoplastic material. The individual layers are normally constituted by parallel impregnated rovings and the cured layer exhibits strong properties in the direction of the fibers, and weak properties in the transverse direction. These layers are commonly supplied in thin (about 0.005 inch thick) sheets or tapes referred to herein as layers. Structural laminates are formed by stacking layers appropriately to resist anticipated loads on the structure, whereupon the stacked layers are appropriately cured to unite the layers and to harden the resin when it is thermosetting in character.

The preferred fiber-reinforced plastic material used in the practice of this invention is a plastic resin hardenable by heat and reinforced by continuous carbon graphite fibers of high strength and rigidity. Particularly preferred resins in current practice are of the thermosetting type, usually epoxy resin blends catalyzed with dicyanidiamide and formulated for toughness and convenience of processing. Examples in commercial use are Narmco Materials 5209 and Fiberite 1048. Both systems use Union Carbide T-300 carbon fiber as reinforcement.

Figure 1:
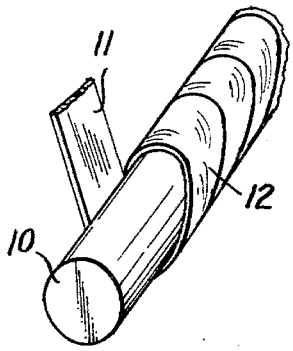
FIGS. 1–4 are a series of diagrammatic partial perspectives showing the series of steps which are used to produce a preferred graphite fiber composite arrow shaft in the present invention. More particularly.
Figure 2:
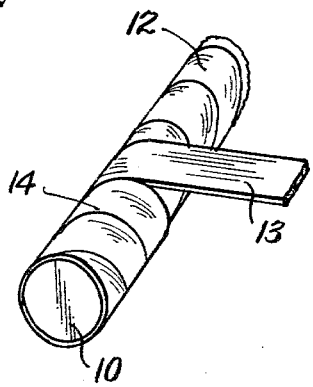
Figure 3:
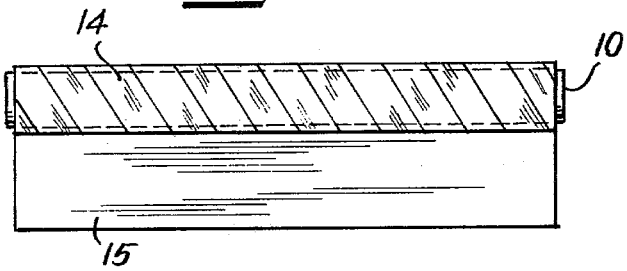

As can be seen in FIG. 1, the strip 11 with its carbon fibers extending longitudinally of the strip is wound, without overlap around the cylindrical mandrel 10, the winding being at an angle to the axis of the mandrel. This forms a first or inner layer 12 which is then wound in the same way, but in the opposite direction, with a strip 13 to provide a second layer 14, as shown in FIG. 2. These layers 12 and 14 provide the interior section of the arrow shaft which is produced and they each contain carbon fibers running in an opposite direction to the axis of the shaft.

The mandrel 10 with layers 12 and 14 thereon is then placed at one edge of a stack of 1–4 layers 15 which have their fibers running parallel to the axis of the wound mandrel. These layers 15 are rectangular with the fibers running in the direction of the length of the rectangle and with the width of the rectangle corresponding with the circumference of the wound mandrel. By rolling the wound mandrel over the layers 15, an appropriate thickness of parallel fibers 16 are provided to constitute the exterior or outer section of the shaft. While the layers 15 can be stacked and wound once, a single layer can be used dimensioned for one or several windings around the wound mandrel.

Figure 4:
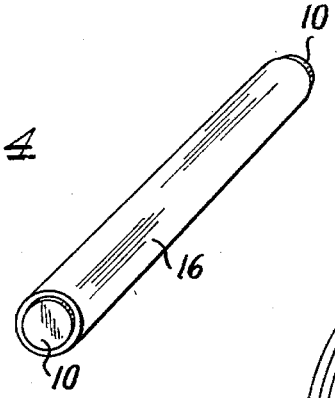

Since the strips 11 and 13 and the stacked layers 15 are impregnated with resin, preferably a heat curable epoxy resin in an intermediate tacky condition, it is now necessary to cure the laminate which has been formed. This is done by overwrapping the wound rod in FIG. 4 with a heat shrinkable tape, preferably polyvinyl acetate film, which applies pressure during the heating cycle when the resin is cured and hardened to its final desired form. A staged cure cycle is commonly used with a final cure temperature of 260° F. for the commercial material systems previously referred to. After cure, the heat shrinkable film is removed from the laminate which may be lightly sanded to remove small ridges of excess cured resin which tend to form along the edges of the wrap pattern of the heat shrinkable film tape. The mandrel 10 is removed to form a tubular arrow shaft 20. A cosmetic finish or coating may be applied to the arrow shaft if desired.

Alternate laminate constructions may be used to change the characteristics of the finished arrow shaft. For example, a woven fabric may be used to form the interior of the shaft. Also, material of thickness other than the standard 5–6 mil ply may be used to create a different wall thickness. Further, the outer layers of axial reinforcement may be aligned slightly away from the axis of the shaft if lower rigidity within the range of permitted flexibility is desired.

Archery arrow shafts have been successfully constructed for evaluation using the designs and fabrication techniques of this invention. Some specific examples of designs utilizing material of standard thickness with measured rigidity characteristics or spine of the resulting arrow shafts are presented in Table I.

TABLE I

| Mandrel Diam. (in.) | Laminate | Measured Spine (29 in. span) Deflec. in inches | Suitable For Bow Draw Wt. |
|---|---|---|---|
| .200 | 2°-O°; +45°; −45° | .525 | #50 |
| .230 | 2°-10°; +45°; −45° | .475 | #55 |
| .230 | 2°-0°; +45°; −45° | .400 | #65 |
| .240 | 2°-0 ; +45°; −45° | .340 | #75 |

Figure 5:
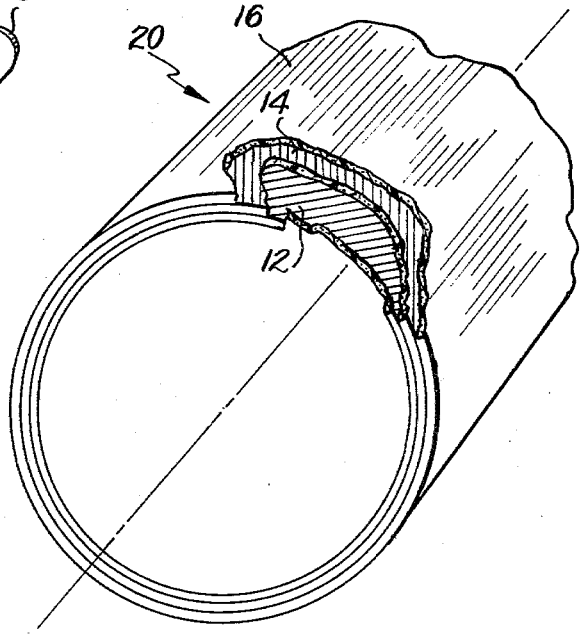
FIG. 5 is a partial perspective view, with parts broken away, showing the structure of the completed arrow shaft.
Figure 6:
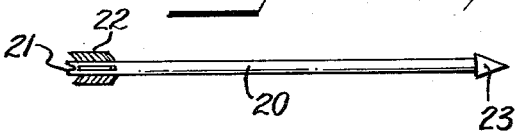
FIG. 6 shows the final arrow.

The structure of arrow shaft 20 is shown in greater detail in FIG. 5 where it will be seen that the shaft 20 is tubular with the wall of the shaft formed of an interior section in which the carbon fibers are at an angle to the axis of the shaft as a result of layers 12 and 14. The fiber on the outer section of the shaft 20 parallel the axis of the shaft to provide the layer 16.

The arrow itself has a nock 21 and fletching 22 at its rear end and a heavy head or tip 23 as previously described.

I claim:

1. A carbon fiber-reinforced plastic arrow having a tubular shaft with a length of from 25 to 32 inches, a wall thickness of from 0.022 to 0.032 inch and an internal diameter of from 0.19 to 0.26 inch, the larger internal diameters and greater wall thicknesses being used with the longer arrow lengths to provide a stiffness measured by center deflection under a two pound center load while simply supported at both ends of from 0.25 to 0.7 inch, said tubular shaft being constructed of carbon fiber-reinforced plastic to include an interior section in which the carbon fibers run in two directions, each balanced with respect to the other, of at least 30° to the axis of the arrow, and an outer section in which substantially all of the fibers are parallel to the axis of the arrow, said arrow including a head at the forward end of the shaft, said head having a weight of from 45% to 60% of the weight of the shaft, said interior section of said tubular shaft is constituted by two layers of parallel carbon fiber rovings, one layer being wound without overlap at one angle to the axis of the arrow, and the other layer being wound without overlap at the opposite angle to the axis of the arrow.

2. A carbon fiber-reinforced plastic arrow as recited in claim 1 in which said outer section of said tubular shaft is constituted by from 1–4 layers of parallel carbon fiber rovings.

3. A carbon fiber-reinforced plastic arrow as recited in claim 1 in which the fibers in said interior section are at an angle of about 45° to the axis of the arrow.

4. A carbon fiber-reinforced plastic arrow as recited in claim 1 in which the stiffness measured by said test yields a center deflection of from 0.35 to 0.65 inch.

* * * * *

UNITED STATES PATENT OFFICE

CERTIFICATE OF CORRECTION

Patent No. 4,234,190 Dated Nov. 18, 1980

Inventor(s) Tom P. Airhart

It is certified that error appears in the above-identified patent and that said Letters Patent are hereby corrected as shown below:

Column 5, lines 27-31, in the "Laminate" column, "2°", in each instance, should read --2--

Signed and Sealed this

*Seventeenth* Day of *February 1981*

[SEAL]

*Attest:*

RENE D. TEGTMEYER

*Attesting Officer*

*Acting Commissioner of Patents and Trademarks*